US012178337B2

(12) United States Patent
Sanchez

(10) Patent No.: US 12,178,337 B2
(45) Date of Patent: Dec. 31, 2024

(54) MATING DISHWARE HAVING AN IMPROVED DRAIN SYSTEM

(71) Applicant: Gilberto E. Sanchez, Tampa, FL (US)

(72) Inventor: Gilberto E. Sanchez, Tampa, FL (US)

( * ) Notice: Subject to any disclaimer, the term of this patent is extended or adjusted under 35 U.S.C. 154(b) by 0 days.

(21) Appl. No.: 18/613,854

(22) Filed: Mar. 22, 2024

(65) Prior Publication Data

US 2024/0268583 A1 Aug. 15, 2024

Related U.S. Application Data

(63) Continuation-in-part of application No. 17/698,598, filed on Mar. 18, 2022, which is a continuation-in-part of application No. 17/162,612, filed on Jan. 29, 2021, now abandoned.

(60) Provisional application No. 63/454,277, filed on Mar. 23, 2023, provisional application No. 63/314,182, filed on Feb. 25, 2022, provisional application No. 62/967,674, filed on Jan. 30, 2020.

(51) Int. Cl.
*A47G 19/22* (2006.01)
*A47G 19/06* (2006.01)

(52) U.S. Cl.
CPC ..... *A47G 19/2255* (2013.01); *A47G 19/06* (2013.01)

(58) Field of Classification Search
CPC . A47G 19/06; A47G 19/2255; A47G 23/0225
See application file for complete search history.

(56) References Cited

U.S. PATENT DOCUMENTS

| | | | |
|---|---|---|---|
| 3,526,335 | A | 9/1970 | Swett et al. |
| 4,643,381 | A | 2/1987 | Levy |
| 5,111,960 | A | 5/1992 | Zilliox |
| 5,971,139 | A | 10/1999 | Bradley |
| 9,132,932 | B2 | 9/2015 | Scharfe et al. |
| 2022/0273122 | A1 | 9/2022 | Sanchez |

FOREIGN PATENT DOCUMENTS

WO WO 2020/174247 A1 9/2020

OTHER PUBLICATIONS

International Search Report and Written Opinion for International Application No. PCT/US24/21139, dated Jul. 24, 2024.

*Primary Examiner* — Andrew D Perreault
(74) *Attorney, Agent, or Firm* — Stephen E. Kelly; Hill Ward Henderson, P.A.

(57) ABSTRACT

A mating food and beverage retaining assembly comprising a serving plate having a collar that has one or more tabs protruding inwardly from the collar and a sloped apron disposed at least partially inside a perimeter defined by the collar. The sloped apron comprises one or more apertures. The serving plate mates with a beverage receptacle having a beverage retaining portion, a stem, and a base having one or more recesses for mating with the one or more tabs. The beverage receptacle is releasably joined to the serving plate by mating the one or more tabs with the one or more recesses. The apertures promote drainage of fluids collecting inside the collar.

19 Claims, 9 Drawing Sheets

MATING DISHWARE HAVING AN IMPROVED DRAIN SYSTEM

CROSS-REFERENCE TO RELATED APPLICATION

Pursuant to 35 U.S.C. §§ 119 (e) and 120, this application (a) is a continuation-in-part of U.S. patent application Ser. No. 17/698,598, filed on Mar. 18, 2022, which (i) is a continuation-in-part of U.S. patent application Ser. No. 17/162,612, filed on Jan. 29, 2021, which claims the benefit of U.S. Provisional Patent Application Ser. No. 62/967,674, filed on Jan. 30, 2020, and (ii) claims the benefit of U.S. Patent Application Ser. No. 63/314,182, filed on Feb. 25, 2022; and (b) claims the benefit of U.S. Provisional Patent Application Ser. No. 63/454,277, filed on Mar. 23, 2023, the entire contents of each of which are incorporated herein by this reference.

BACKGROUND

(1) Field of Endeavor

The present invention relates generally to the field of food and beverage retaining assemblies of the type comprising in combination a serving plate for retention of food and a beverage holder for retention of a liquid, the structure of which enables the user to hold both the serving plate and the beverage holder in one hand, such that food may be taken from the serving plate by the free hand, and further wherein the beverage holder can be separated from and replaced onto the serving plate by the free hand.

(2) Description of Related Art

Food and drink are often served at gatherings where seating is limited or non-existent, such as for example cocktail parties, tailgating events, outdoor parties of the like. Typically, the attendees are provided with plates or trays, often smaller than typical dinner plates, on which to place food and separate, self-standing beverage holders, such as glasses, cups, mugs, and wine glasses or similar stemware. In order to eat an item from the plate, the user must put down the beverage holder on a flat surface, carefully balance the beverage holder on an empty portion of the plate, or attempt to hold both plate and beverage holder in one hand in order to free up one hand to grasp the food. This may often result in spilling of the beverage, the food or both.

To address this problem two main approaches have been pursued. In the first solution, the plate is provided with a beverage holder receiving structure, such as a short annular wall extending upward from the plate surface into which the circular base or bottom of the beverage holder is placed. The wall limits lateral movement of the beverage holder on the plate in order to stabilize the beverage holder. This solution is not optimal in that the beverage holder receiving structure reduces the area on the plate available to receive food, does not work well when the diameter of the base or bottom of the beverage holders is significantly smaller than the diameter of the beverage holder receiving structure, and does not work at all with beverage holders having diameters greater than the beverage holder receiving structures, and in particular does not work well with stemware beverage holders having a high center of gravity, such as for example a full wine glass or champagne flute. Since with these devices the beverage holder is not secured to the plate, the user must support the bottom of the plate or hold the edge of the plate while continuously maintaining careful balance of the plate to avoid tipping the beverage holder.

A second solution is to provide the plate with an edge slot or a circular aperture, within the interior or extending from the edge, to receive the beverage holder. The edge slot is sized to receive the laterally-inserted small diameter stem of the stemware such that the larger upper beverage retaining portion of the beverage holder rests upon the top surface of the plate. In the aperture version, the aperture is only suitable with a beverage holder having a tapered or curved wall larger than its base, since the aperture must be sized to allow the base of the beverage holder to pass through while precluding the larger diameter upper portion of the beverage holder from passing completely through the circular aperture. Both of these designs significantly reduce the available area for food, cannot be used with beverage holders having a straight wall or a base larger than the upper beverage retaining portion, such as a champagne flute, will not allow different beverage holders to be used with a single plate, and present combinations with low stability.

It is an object of this invention to provide a food and beverage retaining assembly comprising in combination a serving plate mechanically interlocked with a releasable, baseless, stemmed beverage receptacle that effectively addresses the problems inherent in the plate and beverage holder combinations described above, wherein the combined plate and beverage receptacle does not significantly reduce the area available on the plate to receive food, can be used with beverage receptacles having upper beverage retaining portions of any shape or style, provides a stable and secure combination wherein the beverage receptacle is removably and replaceably mechanically interlocked with the plate, such that user can hold the combined plate and beverage receptacle by holding either the plate or the upper beverage retaining portion.

SUMMARY

In brief summary, the invention in various embodiments is a food and beverage retaining assembly comprising the combination of a serving plate, a removable, baseless, stemmed beverage receptacle, and a securement fitting assembly, wherein the beverage receptacle is mechanically interlocked or mated with the serving plate in a manner that allows the beverage receptacle to be repeatedly removed and replaced without requiring the serving plate to be placed onto a horizontal surface. The beverage receptacle comprises an upper beverage retaining portion joined to a neck or stem. The upper beverage retaining portion may have various shapes and sizes, similar to the beverage retaining portions of stemmed beverage holders (e.g., wine glasses, champagne flutes, martini glasses) and non-stemmed beverage holders (e.g., cups, glasses, mugs). The plate comprises an upper surface to support food and, in a preferred embodiment, a stem receptacle or receiving socket extending upwardly from the upper surface which is structured to mechanically interlock with the free insertion end of the stem, the insertion end of the stem having a securement member structured to mechanically interlock with corresponding mating structure of the stem socket on the serving plate. Together the stem securement member and the stem socket define a securement fitting assembly such that the plate secures and retains the beverage receptacle. In an alternative embodiment, the beverage receptacle stem may be provided with a receiving socket and the serving plate provided with a post member to be received in the receiving socket.

In a preferred embodiment, the stem socket comprises an annular wall having a substantially L-shaped slot with a vertical segment extending to the upper surface of the annular wall and a horizontal segment extending along or within the annular wall. The securement member of the stem comprises a radially extending protrusion, such as a tab, post, pin, or the like, sized to fit within the L-shaped slot. Such a mating securement combination is often referred to as a bayonet coupling or fitting. To secure the beverage receptacle to the serving plate, the stem tab is aligned with the upper opening of the L-shaped slot, the stem is pushed downward into the annular wall of the stem socket, and the stem is rotated such that the tab is moved laterally into the horizontal segment. In this manner the beverage receptacle is secured to the serving plate and relative vertical movement is precluded. To remove the beverage receptacle from the serving plate, the stem is rotated in the opposite direction such that the tab is aligned with the vertical segment and the beverage receptacle is moved upwardly away from the serving plate so as to clear the stem socket.

DESCRIPTION OF THE PREFERRED EMBODIMENT

As used herein, the term "serving plate" shall refer to any dinner plate, cocktail plate, party plate, or any similar tray device of any shape and size easily supported in one hand and structured to receive food thereon. The term "beverage receptacle" as used in herein shall refer to a baseless, stemmed receptacle for liquid having an upper beverage retaining portion joined to a neck or stem, preferably elongated, of much smaller transverse dimension or cross-section than the upper beverage retaining portion. The term "baseless" shall mean that the beverage receptacle lacks a physical structure capable of maintaining the beverage receptacle in an upright, liquid-retaining position on a horizontal surface. Thus, the baseless, stemmed beverage receptacle, when removed from the serving plate, cannot be placed onto a surface in the upright position, i.e., it cannot stand on its own. The term "mechanically interlocked" or its variations shall refer to a physical interconnection of mating structures, such as for example a tab and a slot, a pin or post and a slot, a short screw threading, or the like, as opposed to the joining of two objects by a friction fit. The term "securement fitting assembly" shall refer to a combination of physical structures present on the serving plate and the stem of the beverage receptacle that enable the beverage receptacle to be releasably mechanically interlocked with the serving plate.

Figure 1:
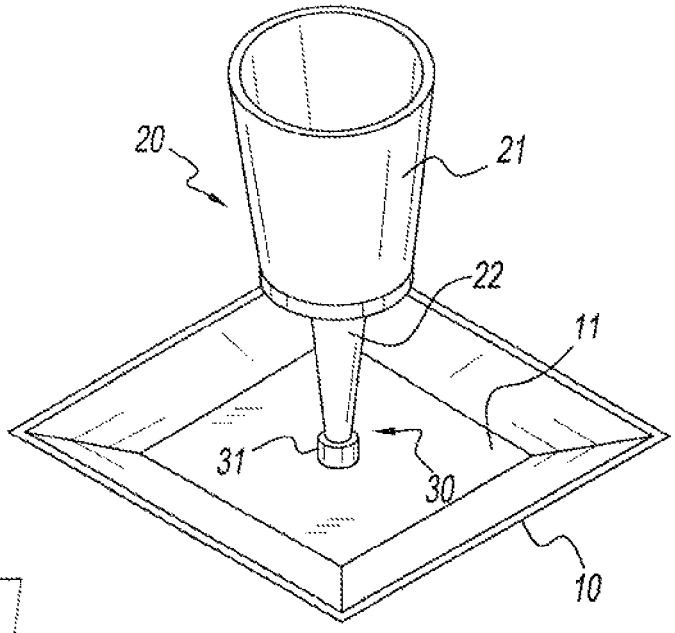
FIG. 1 is a perspective view illustrating an embodiment of the invention wherein a baseless, stemmed beverage receptacle is mated with a serving plate.
Figure 2:
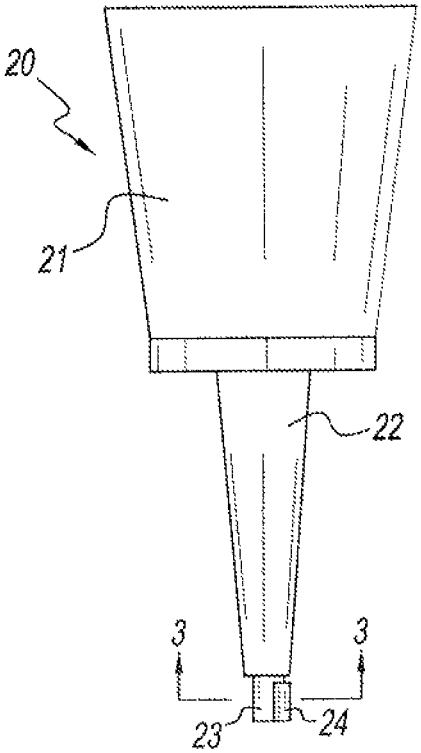
FIG. 2 is a side view of the baseless, stemmed beverage receptacle of FIG. 1.

The invention will now be described in detail in combination with the drawings. In general, the invention in various embodiments is a food and beverage retaining assembly comprising the combination of a serving plate 10 and a removable, baseless, stemmed beverage receptacle 20, as shown in FIG. 1, wherein the beverage receptacle 20 is removably or releasably mechanically interlocked with the serving plate 10 by a securement fitting assembly 30. As shown in FIG. 2, the beverage receptacle 20 comprises an upper beverage retaining portion 21 joined to a neck or stem 22, the stem 22 being of significantly narrower diameter than the upper beverage retaining portions 21 and preferably elongated so as to raise the bottom of the upper beverage retaining portion 21 to allow for more food to be placed onto the serving plate 10 beneath the upper beverage retaining portion 21, with the upper beverage retaining portion 21 being of suitable volume in order to retain a quantity of liquid. The upper beverage retaining portion 21 may have various shapes and sizes, and may be similar to the beverage retaining portions of typical stemmed beverage holders (e.g., wine glasses, champagne flutes, martini glasses) and typical non-stemmed beverage holders (e.g., cups, glasses, mugs).

Figure 6:
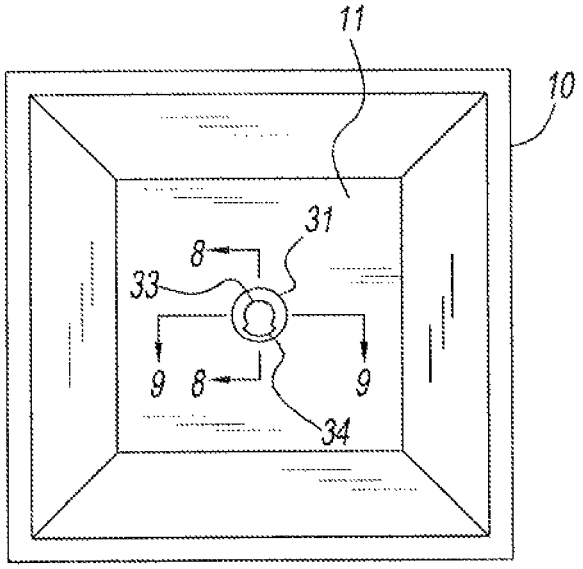
FIG. 6 is a top view of the serving plate of FIG. 1.

The plate 10, as shown in FIG. 6, comprises an upper surface 11 to support food and a stem receptacle or socket 31 positioned on the upper surface 11. The dimensions of the food and beverage retaining assembly may vary, and the food and beverage retaining assembly may be formed of plastic, metal, glass, ceramic or any other suitable material. The food and beverage retaining assembly comprising may be designed for single use, i.e., disposable, or for multiple uses after cleaning.

In the preferred embodiment, the stem socket 31 is structured to mechanically interlock with the insertion end 23 of the stem 22, the insertion end 23 of the stem 22 having a securement member 24 structured to mechanically interlock with the stem socket 31 on the serving plate 10. Together the stem securement member 24 and the stem socket 31 define a securement fitting assembly 30 that allows the beverage receptacle 20 to be readily disengaged from and reengaged with the serving plate 10 while eating and drinking.

Figure 7:
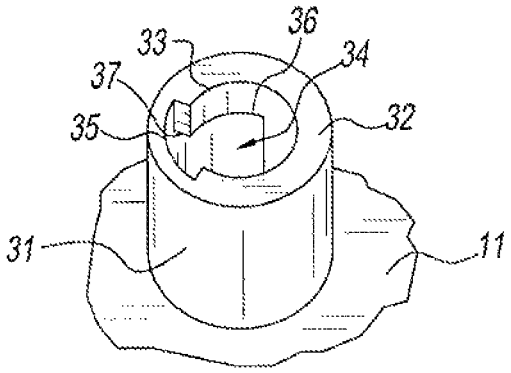
FIG. 7 is a perspective view of the stem socket of FIG. 1 illustrating the L-shaped slot.
Figure 8:
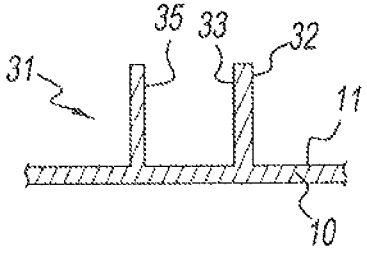
FIG. 8 is a partial cross-sectional view taken along line 8-8 of FIG. 6 illustrating the vertical segment of the L-shaped slot.
Figure 9:
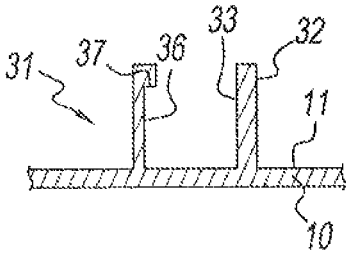
FIG. 9 is a partial cross-sectional view taken along line 9-9 of FIG. 6 illustrating the horizontal segment and retention shoulder of the L-shaped slot.
Figure 10:
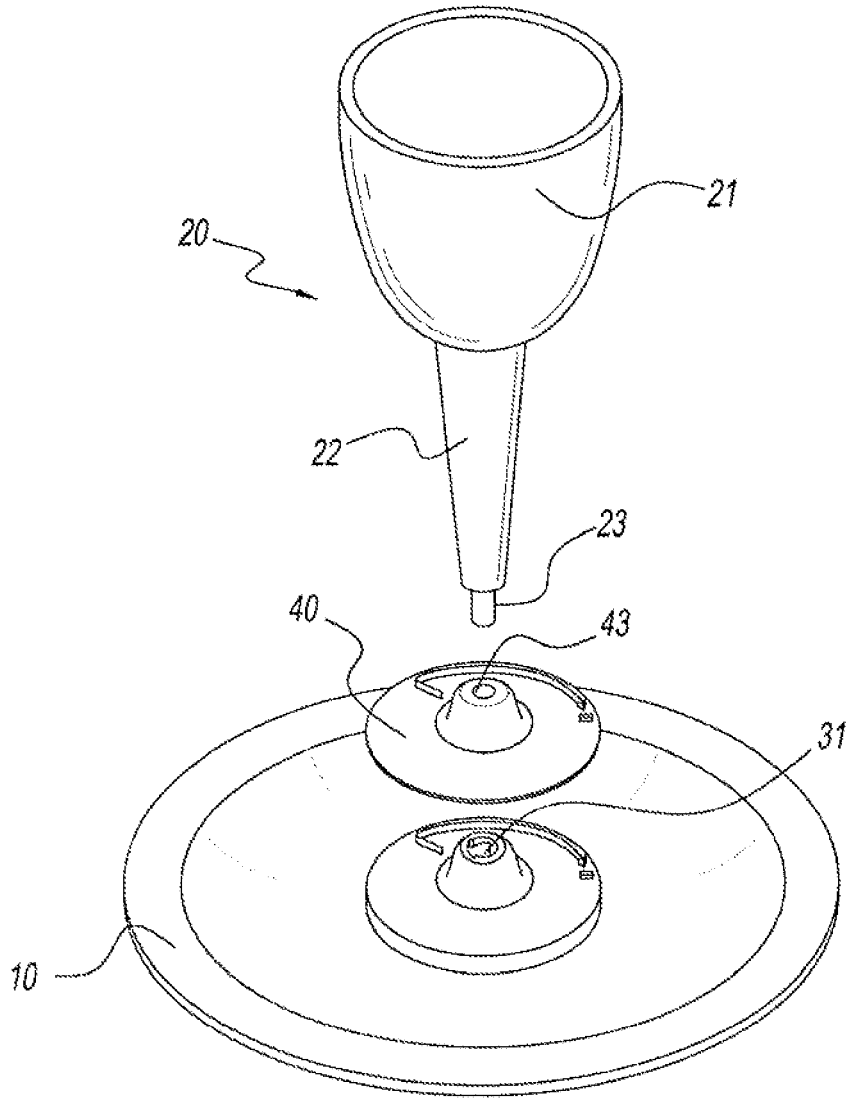
FIG. 10 is an exploded view of an embodiment in which the stem is connected to a base.
Figure 11:
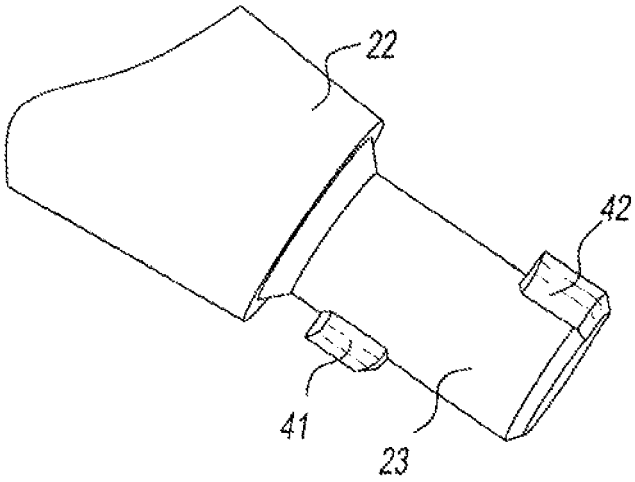
FIG. 11 is an enlarged view of the insertion end of the stem shown in FIG. 10.
Figure 12:
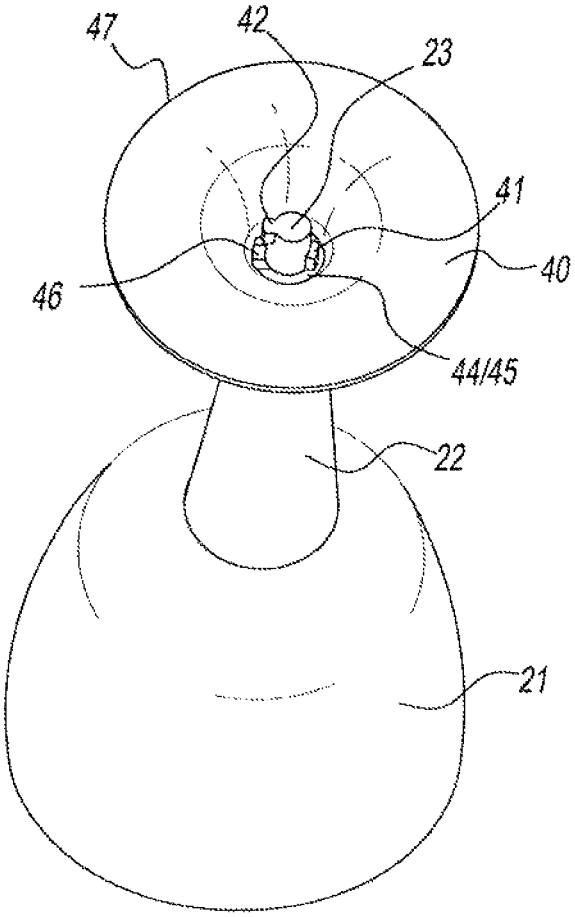
FIG. 12 is a bottom perspective view of the stem connected to the base of the embodiment shown in FIG. 10.

As shown in FIGS. 7-9, the stem socket 31 comprises an annular wall 32 defining a central recess or bore 33. A substantially L-shaped slot 34 is disposed on the interior of or extending through the annular wall 32, the L-shaped slot 34 having a vertical segment 35 extending to the upper surface of the annular wall 32, as shown in FIG. 8, and a horizontal segment 36 extending along or within the annular wall 32, as shown in FIG. 9. The horizontal segment 36 defines a retention shoulder 37 that precludes vertical movement of the stem securement member 24. The horizontal segment 36 should be of a length which precludes further rotation of the securement member 24 once the securement member 24 is substantially or fully positioned beneath the retention shoulder 37 a sufficient distance to preclude vertical movement, as any excess extension of the horizontal segment 36 would make removal of the beverage receptacle 20 more difficult to accomplish. A maximum rotation of 90 degrees or less, and preferably of 45 degrees or less, is suitable for the purpose. Alternative configurations for the slot 34 may also be utilized, such as incorporating curves or angles other than 90 degrees.

Figure 3:
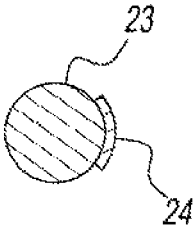
FIG. 3 is a cross-sectional view taken along line 3-3 of FIG. 2 showing the insertion end and securement member, wherein the securement member is a tab.
Figure 4:
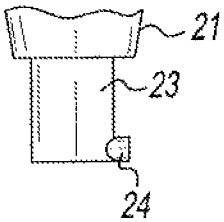
FIG. 4 is an illustration of an alternative embodiment for the securement member, wherein the securement member is a pin.

The securement member 24 of the stem 22 comprises a radially extending protrusion, such as a tab, as shown in FIGS. 3 and 4, or a post or pin, as shown in FIG. 4. The tab, pin, post, or similarly structured securement member 24 is sized to fit within the L-shaped slot 34, and is referred to hereafter collectively as a tab 24. Such a securement fitting assembly 30 is often referred to as a bayonet coupling or fitting. To secure the beverage receptacle 20 to the serving plate 10, the stem 22 of the beverage receptacle 20 is aligned with the stem socket 31 and the stem tab 24 is aligned with the upper opening of the vertical segment 35 of the L-shaped slot 34. The stem 22 is pushed downward into the annular wall 32 of the stem socket 31 and the stem 22 is rotated such that the tab 24 is moved into the horizontal segment 36 of the L-shaped slot 34 such that relative vertical movement is precluded by the retention shoulder 37, thereby securing the beverage receptacle 20 to the serving plate 10. The outer diameter of the stem 22 should be slightly smaller than the inner diameter of the stem socket 31 such that excessive friction does not occur between the stem 22 and the socket 31. In this manner, with the beverage receptacle 20 mated with the serving plate 10, the user only needs one hand to hold both the plate 10 and the drinking receptacle 20. To remove the beverage receptacle 20 from the serving plate 10, the user grasps or supports the serving plate 10 with one hand and grasps the beverage receptacle 20 with the other. The stem 22 is rotated in the opposite direction such that the tab 24 becomes re-aligned with the vertical segment 35, allowing upward movement of the stem 22 and separation of the beverage receptacle 20 from the serving plate 10. Once removed from the plate 10, the baseless, stemmed beverage receptacle 20 cannot be placed onto a horizontal surface, as the insertion end 23 of the stem 22 is unsuitable to support the beverage retaining portion 21.

Figure 5:
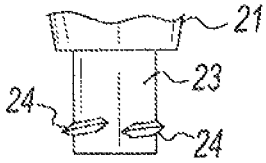
FIG. 5 is an illustration of an alternative embodiment for the securement member, wherein the securement member is a pair of short screw threads.

Alternatively, it is understood that other mechanical interlocking designs and structures are possible for the securement fitting assembly, such as for example the use of one or more mating helical thread segments disposed on the insertion end 23 of the stem 22, as shown in FIG. 5, with corresponding grooves on the annular wall 32 of the stem socket 31. Furthermore, the securement fitting assembly 30 may be reversed, such that for example insertion end 23 of the stem 22 is provided with a socket structure and the serving plate 10 is provided with an upwardly extending post and a lateral tab.

With this structure, the beverage receptacle 20 is secured to the serving plate 10 in an easily releasable and replaceable manner, such that when the user desires to drink from the beverage receptacle 20, it is removed by rotating the beverage receptacle 20 and separating it from the serving plate 10. When a free hand is needed to remove food from the serving plate 10 or load food onto the serving plate 10, the beverage receptacle 20 is re-mounted onto the serving plate 10 as described. Because of the secure connection between the beverage receptacle 20 and the serving plate 10, the user may hold the combined assembly by the holding the underside of the upper beverage retaining portion 21 of the beverage receptacle 20 in addition to being able to hold the combined assembly by grasping the edge or supporting the bottom of the plate 10.

A mechanical interlocking design is preferable to a friction-fit design for several reasons. With a mechanical interlock design manufacturing does not have to be as precise, as the tolerances between the mating structures can be much greater than is possible for friction-fit structures. Securing and releasing the beverage receptacle 20 from the serving plate 10 is easier with a relatively looser mechanical interlock (turn and lift or insert and turn) than with a friction-fit (high resistance to both insertion and removal). Additionally, after multiple removals and insertions a friction-fit may become inadequate due to wearing, which can lead to accidental separation of the serving plate 10 when the user holds the combined device by the beverage receptacle 20.

In another embodiment, shown in FIGS. 10-13, the fitting assembly 30 further comprises a base 40 that enables the beverage receptacle 20 to stand on a table, desk, or other horizontal surface independently of the serving plate 10. In one embodiment, the base 40 is a contoured annular flange that resembles the base of stemware, such as the base of a wine glass, champagne flute, martini glass, or the like. In this embodiment, the insertion end 23, shown in FIG. 11, comprises a first stem securement member 41 and a second stem securement member 42. In the exemplary embodiment shown in FIG. 11, the first and second stem securement members 41, 42 are disposed on opposite sides of the insertion end 23, approximately 180° apart. Other angles, such as 90°, 60°, or other angles could also be used. The base 40 comprises a passageway 43 (see FIG. 10) having an annular C-shaped collar 44 (see FIG. 12) with a contact surface 45 and a gap 46.

In the exemplary embodiment, to secure the stem 22 to the base 40, the second stem securement member 42 is aligned with the gap 46, and the insertion end 23 is inserted through the passageway 43 until the second stem securement member 42 clears the C-shaped collar 44. The stem 22 is then rotated with respect to the base 40 to align the first stem securement member 41 with the gap 46. The insertion end 23 is then further advanced though the passageway 43 until the first stem securement member 41 clears the C-shaped collar 44. The stem 22 is then rotated again with respect to the base 40 such that the first stem securement member 41 travels under the C-shaped collar 44. The stem 22 is thereby prevented from backing out of the passageway 43 by the first stem securement member 41 abutting against the contact surface 45 of the C-shaped collar 44.

Once the base 40 is attached to the stem 22 as described above, the beverage receptacle 20 can be attached to the serving plate 10 by insertion of the second stem securing member 42 into the stem socket 31, as described above.

Figure 13:
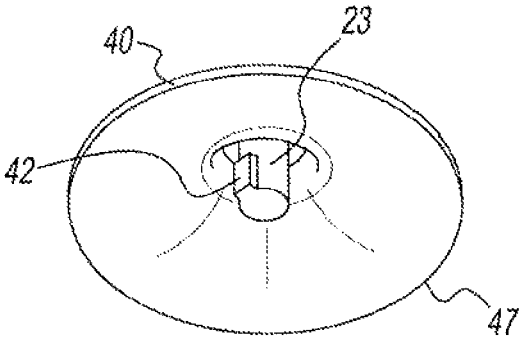
FIG. 13 is an enlarged view of the insertion end connected to the base of the embodiment shown in FIG. 10.
Figure 14:
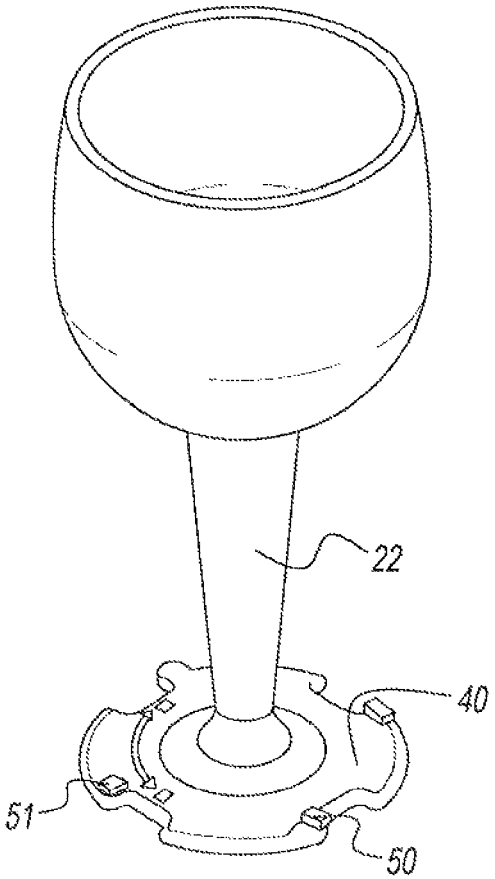
FIG. 14 is a perspective view of an embodiment of a beverage receptacle having a stem connected to a base that has recesses for engaging tabs on the serving plate.
Figure 15:
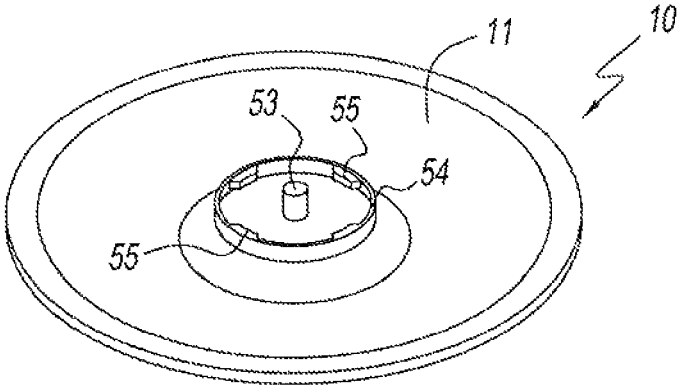
FIG. 15 is a perspective view of an embodiment of a serving plate that mates with the beverage receptacle of FIG. 14.
Figure 16:
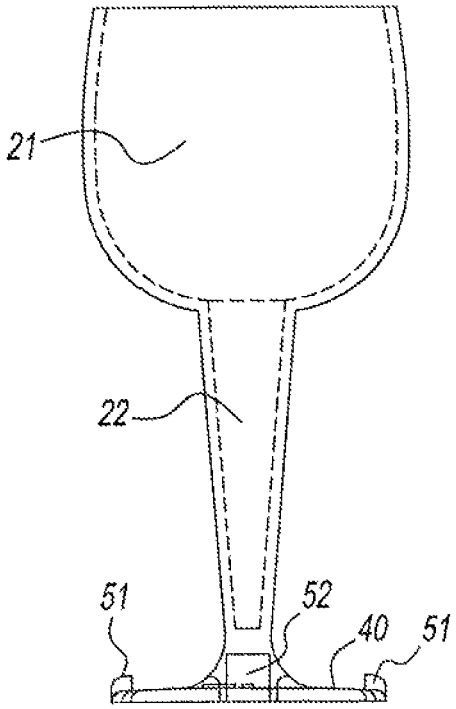
FIG. 16 is a side view of the beverage receptacle of FIG. 14.
Figure 17:
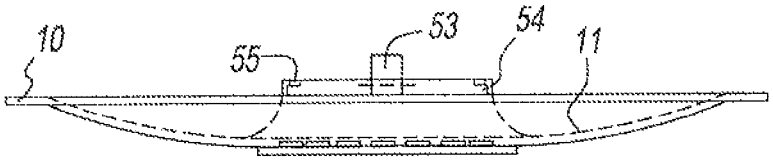
FIG. 17 is a side view of the serving plate of FIG. 15.
Figure 18:
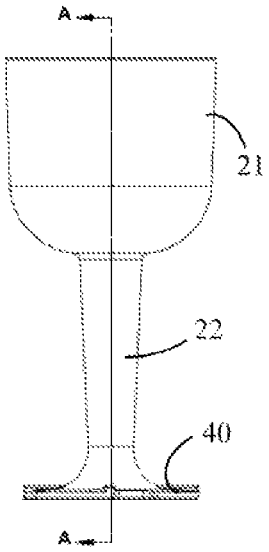
FIG. 18 is a side view of an embodiment of beverage receptacle having a stem connected to a base that has recesses for engaging tabs on the serving plate.
Figure 19:
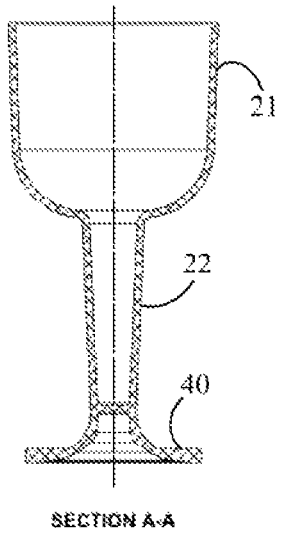
FIG. 19 is cross section A-A.
Figure 20:
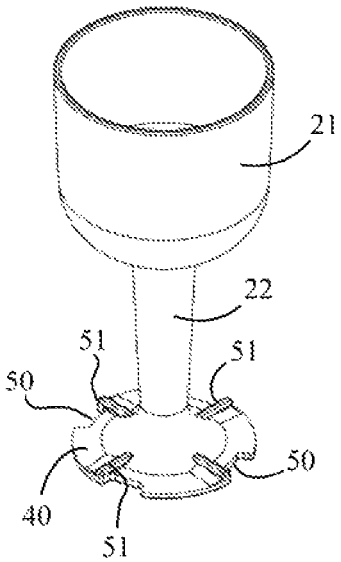
FIG. 20 is a perspective view of the embodiment shown in FIG. 18.
Figure 21:
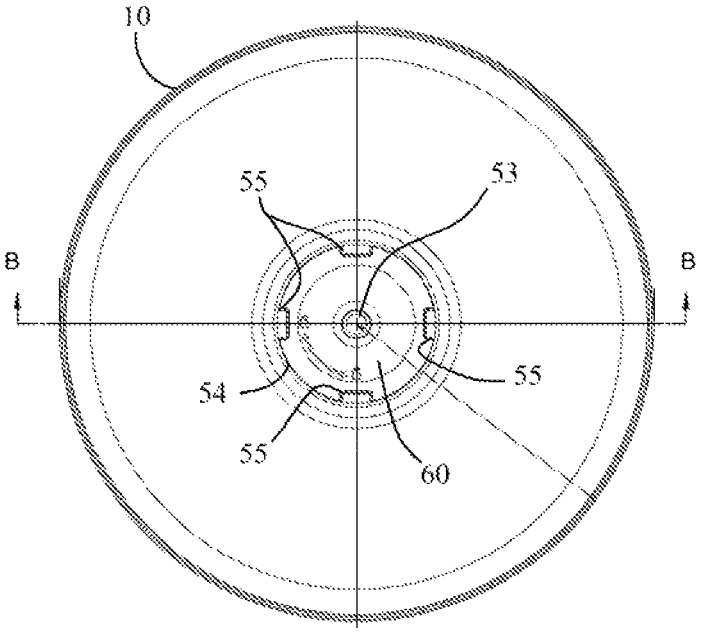
FIG. 21 is a top view of an embodiment of a serving plate having a drain system disposed centrally.
Figure 22:
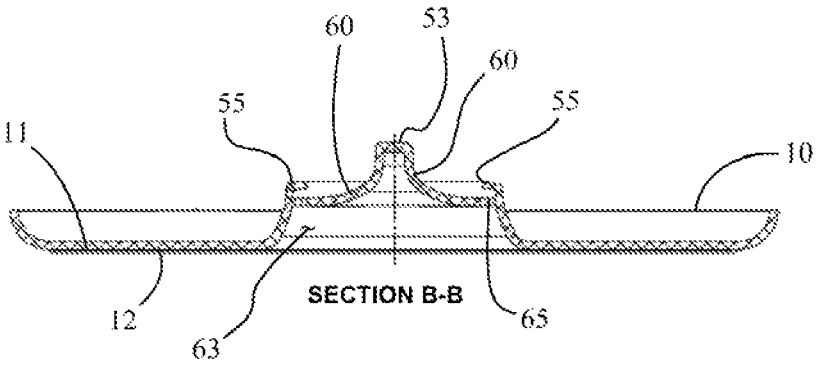
FIG. 22 is cross section B-B.
Figure 23:
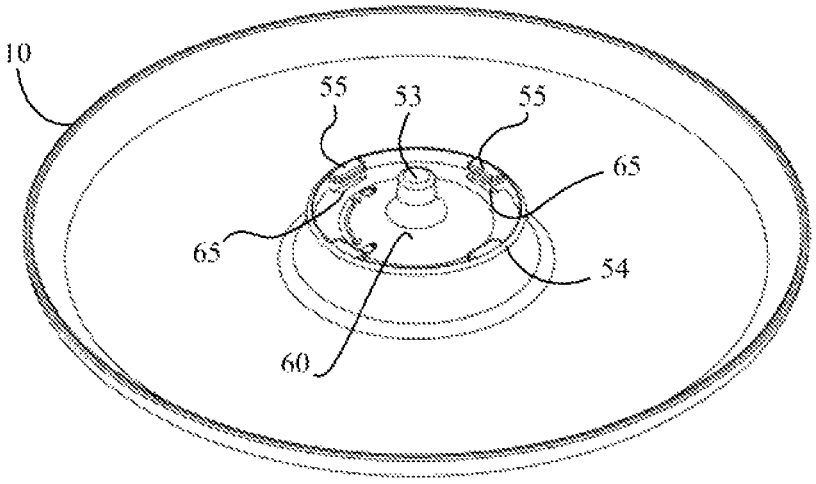
FIG. 23 is a perspective view of the serving plate shown in FIG. 21.
Figure 24:
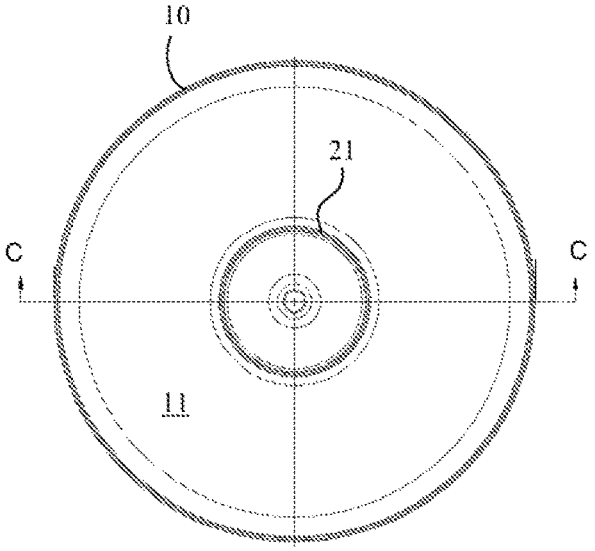
FIG. 24 is a top view of the serving plate of FIG. 21 having the beverage receptacle of FIG. 18 disposed thereon.
Figure 25:
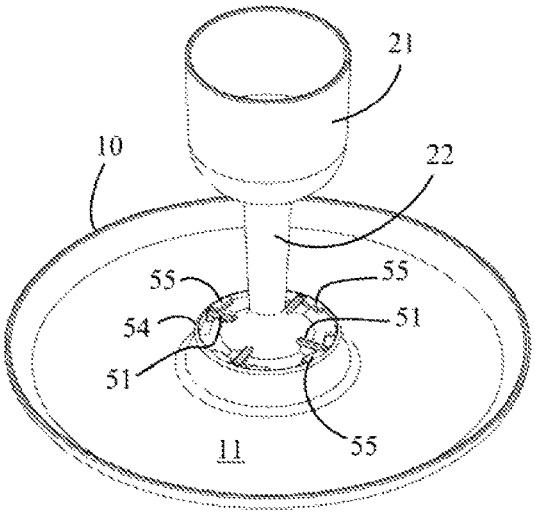
FIG. 25 is a perspective view of the embodiment shown in FIG. 24.
Figure 26:
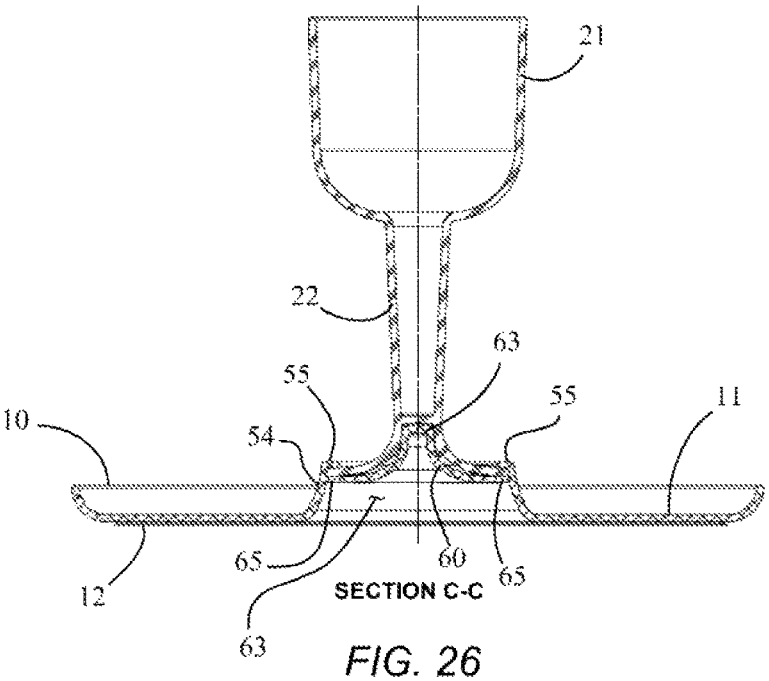
FIG. 26 is cross section C-C.

In one embodiment of the base 40, as shown in FIG. 13, the base 40 is contoured such that the outer edge 47 of the base 40 is disposed lower than the passageway 43, and tip of the insertion end 23 remains above the edge 47 when the base 40 is fully secured to the stem 22. In this configuration, the insertion end 22 does not interfere with the base 40 uniformly contacting a supporting surface on a table or desk when the beverage receptacle 20 is separated from the serving plate 10. If the insertion end 23 extended lower than the edge 47, then the beverage receptacle 20 could become unstable when placed on a table, desk, or other flat surface.

In another embodiment of the beverage retaining assembly, shown in FIGS. 14-17, the serving plate 10 further comprises a locking assembly 58. In this embodiment, the base 40 is attached to the stem 22, by any of the methods described above, by a friction fit, or by gluing, hot welding, or by some other suitable method or mechanism. The base 40 further comprises a post socket 52 and one or more recesses 50, one or more of which are flanked by a stop 51. Each stop 51 is a nub, bump, protrusion, detent, or other suitable member for preventing over-rotation of the base 40, as described below. The serving plate's 10 locking assembly comprises a post 53 disposed inside a collar 54 that has one or more tabs 55 for mating with the recesses 50 in the base. The post 53 projects upwardly from the serving plate 10 in an orientation that is substantially perpendicular to the upper surface 11. The collar 54 comprises a vertical wall that projects upwardly from the upper surface 11. Each tab 55 is attached to the top of the collar 54 and projects radially inward toward the post 53.

To attach the beverage receptacle 20 to the serving plate 10, the recesses 50 are aligned with mating tabs 55 on the collar 54, while the post socket 52 is aligned with the post 53. The base 40 is then inserted into the collar 54 such that the post 53 is inserted into the post socket 52 and the tabs 55 pass through the recesses 50. Thus, at least a portion of a top surface of the base 40 is disposed below a top edge of the collar 54. This is an unlocked position of the base 40.

To lock the base 40 to the serving plate 10, the base 40 is then rotated with respect to the serving plate 10 until the one or more stops 51 are disposed in abutting contact with one or more tabs 55, thereby preventing further rotation of the base 40 with respect to the serving plate 10. This is the locked position of the base 40. In this configuration, a bottom surface of the one or more tabs 55 is disposed in contact with an upper surface the base 40, thereby retaining the base 40 in contact with the upper surface 11 and locking the beverage receptacle 20 to the serving plate 10. In this position, at least a portion of a top surface of the base 40 is disposed below a top edge of the collar 54. In this configuration, the portion of the base disposed between the recesses 50 slides below the tabs 55 such that at least a portion of a top surface of the base is disposed below the tab. Therefore, at least a portion of the top surface of the base is disposed below the top edge of the collar 54.

In one embodiment of the unlocked position, the post 53 fits snugly into the post socket 52, thereby providing lateral stability to the beverage receptacle 20. This lateral stability prevents the beverage receptacle 20 from tipping over, wobbling, or otherwise becoming unstable with respect to the serving plate 10 while the beverage receptacle 20 is resting upon the serving plate 20. This improved lateral stability prevents spillage even if the user fails or forgets to rotate the base 40 into its locked position. In fact, the serving plate 10 can be tilted up to about 90° without the post socket 52 becoming dislodged from the post 53, even when the base 40 is in the unlocked position (although any food or beverages are likely to spill).

In another embodiment, shown in FIGS. 18-26, the locking assembly further comprises a drain system having a sloped apron 60 having one or more apertures 65 for draining fluid. The sloped apron 60 is disposed annularly around the post 53 inside the collar 54. The sloped apron 60 is configured such that it is higher (i.e. further from the upper surface 11) in proximity to the post 53, and lower (i.e. closer to the upper surface 11) in proximity to the collar 54. Thus, the configuration of the sloped apron 60 is such that fluid collected by the sloped apron 60 flows away from the post 53 and towards the collar 54.

In one embodiment, the sloped apron 60 is disposed above a bottom 12 of the serving plate 10 such that an annular wall of the collar 54 defines the side portions of a collection recess 63, and the sloped apron 60 defines a top portion of the collection recess 63. In another configuration, the bottom surface 12 of the serving plate 10 may be extended, thereby defining a bottom portion of the collection recess 63.

The drainage system further comprises one or more apertures 65 that are configured for draining fluid that accumulates inside the collar 54. Preferably, each aperture 65 is disposed in the sloped apron 60, and preferably disposed in proximity to the collar 54, which is the lowest part of the sloped apron 60. The apertures 65 may have a rectangular shape, a circular shape, or any other shape suitable to drain fluid from the sloped apron 60 into the reservoir 63 as described below.

In use, any condensation, spillage, or other fluid running down the stem 22 and base 40, and any fluid spilling onto the stem 22 or base 40, is collected by the sloped apron 60. The fluid then runs down the sloped apron 60, away from the post 53 and toward the one or more apertures 65. The fluid then passes through the one or more apertures 65 and exits the upper surface 11 of the serving plate 10. For example, the fluid may flow down the stem 22 and/or base 40, flow through the one or more recesses 50, and onto a top surface of the sloped apron 60. The fluid then flows down the sloped apron 60 to the one or more apertures 65, where the fluid exits the serving plate 10.

In embodiments having a collection recess 63, the fluid exits through the one or more apertures 65 and enters into the collection recess 63. Thus, the drain system is configured to manage fluid on the beverage retaining assembly to prevent spillage, leakage, and the unwanted mixing of fluids with food on the serving plate 10. To promote proper drainage, one embodiment of the base 40 comprises a top surface that is sloped downwardly in a radial direction away from the stem 22. The base 40 may further comprise a bottom surface that generally matches and mates to the contours of a top surface of the sloped apron 60.

The foregoing embodiments are merely representative of the stabilizing mechanism for the dishware set and not meant for limitation of the invention. For example, persons skilled in the art would readily appreciate that there are several embodiments and configurations of fitting assemblies that will not substantially alter the nature of the stabilizing mechanism. Consequently, it is understood that equivalents and substitutions for certain elements and components set forth above are part of the invention described herein, and the true scope of the invention is set forth in the claims below.

What is claimed is:

1. A mating food and beverage retaining assembly comprising:

a serving plate having a collar that has one or more tabs protruding inwardly from the collar;

a sloped apron disposed at least partially inside a perimeter defined by the collar, the sloped apron comprising one or more apertures configured for draining fluid that accumulates inside the collar; and a beverage receptacle having a beverage retaining portion, a stem, and a base having one or more recesses for mating with the one or more tabs;

wherein the beverage receptacle is releasably joined to the serving plate by mating the one or more tabs with the one or more recesses.

2. The mating food and beverage retaining assembly of claim 1, wherein at least one of the one or more recesses is flanked by a stop.

3. The mating food and beverage retaining assembly of claim 1, wherein an unlocked position of the beverage receptacle in relation to the serving plate is defined by the one or more recesses disposed in alignment with the one or more tabs.

4. The mating food and beverage retaining assembly of claim 1, wherein the base further comprises a stop, and a locked position of the beverage receptacle in relation to the serving plate comprises the stop being disposed in abutting contact with the one or more tabs.

5. The mating food and beverage retaining assembly of claim 3, wherein the base further comprises a stop, and a locked position of the beverage receptacle in relation to the serving plate comprises the stop being disposed in abutting contact with the one or more tabs.

6. The mating food and beverage retaining assembly of claim 1, the beverage receptacle having an unlocked position and a locked position in relation to the serving plate, the locked position defined by at least a portion of a top surface of the base being disposed under at least one of the one or more inwardly protruding tabs, and at least a portion of the top surface of the base being disposed below a top edge of the collar.

7. The mating food and beverage retaining assembly of claim 6, wherein at least one of the one or more recesses is flanked by a stop.

8. The mating food and beverage retaining assembly of claim 6, wherein the unlocked position is defined by the one or more recesses disposed in alignment with the one or more tabs.

9. The mating food and beverage retaining assembly of claim 6, wherein the base further comprises a stop, and a locked position further comprises the stop being disposed in abutting contact with the one or more tabs.

10. The mating food and beverage retaining assembly of claim 1, wherein the serving plate further comprises a post disposed inside the collar and the base has a post socket, wherein the beverage receptacle is releasably joined to the serving plate by mating the post to the post socket.

11. The mating food and beverage retaining assembly of claim 10, wherein the unlocked position is further defined by mating the post with the post socket when the tabs are aligned with the recesses.

12. The mating food and beverage retaining assembly of claim 11, wherein at least one of the one or more recesses is flanked by a stop.

13. The mating food and beverage retaining assembly of claim 11, wherein an unlocked position of the beverage receptacle in relation to the serving plate is defined by the one or more recesses disposed in alignment with the one or more tabs.

14. The mating food and beverage retaining assembly of claim 11, wherein the base further comprises a stop, and a locked position of the beverage receptacle in relation to the serving plate comprises the stop being disposed in abutting contact with the one or more tabs.

15. The mating food and beverage retaining assembly of claim 13, wherein the base further comprises a stop, and a locked position of the beverage receptacle in relation to the serving plate comprises the stop being disposed in abutting contact with the one or more tabs.

16. The mating food and beverage retaining assembly of claim 11, the beverage receptacle having an unlocked position and a locked position in relation to the serving plate, the locked position defined by at least a portion of a top surface of the base being disposed under at least one of the one or more inwardly protruding tabs, and at least a portion of the top surface of the base being disposed below a top edge of the collar.

17. The mating food and beverage retaining assembly of claim 16, wherein at least one of the one or more recesses is flanked by a stop.

18. The mating food and beverage retaining assembly of claim 16, wherein the unlocked position is defined by the one or more recesses disposed in alignment with the one or more tabs.

19. The mating food and beverage retaining assembly of claim 16, wherein the base further comprises a stop, and a locked position further comprises the stop being disposed in abutting contact with the one or more tabs.

* * * * *